US010926132B1

(12) United States Patent
Lo

(10) Patent No.: US 10,926,132 B1
(45) Date of Patent: Feb. 23, 2021

(54) LINKAGE MECHANISM WITH HANDLES LINKED TO ELLIPTICAL MOTION TRAJECTORY

(71) Applicant: HEALTHSTREAM TAIWAN INC., Taoyuan (TW)

(72) Inventor: Yi-Chung Lo, Taoyuan (TW)

(73) Assignee: Healthstream Taiwan Inc., Taoyuan (TW)

( * ) Notice: Subject to any disclaimer, the term of this patent is extended or adjusted under 35 U.S.C. 154(b) by 0 days.

(21) Appl. No.: 16/726,695

(22) Filed: Dec. 24, 2019

(30) Foreign Application Priority Data

Dec. 17, 2019 (TW) ..... 108146296

(51) Int. Cl.
*A63B 22/06* (2006.01)
*A63B 22/00* (2006.01)
*A63B 21/22* (2006.01)

(52) U.S. Cl.
CPC ..... *A63B 22/0664* (2013.01); *A63B 21/225* (2013.01); *A63B 22/001* (2013.01); *A63B 22/0048* (2013.01); *A63B 2022/0676* (2013.01); *A63B 2208/0204* (2013.01)

(58) Field of Classification Search
CPC ..... A63B 22/0664; A63B 22/0048; A63B 22/001; A63B 21/225; A63B 2208/0204; A63B 2022/0676
See application file for complete search history.

(56) References Cited

U.S. PATENT DOCUMENTS 6,063,008 A * 5/2000 McBride ..... A63B 22/001 482/52
6,551,217 B2 * 4/2003 Kaganovsky ..... A63B 22/0664 482/51
7,022,049 B2 * 4/2006 Ryan ..... A63B 22/001 482/51
7,037,242 B2 * 5/2006 Lo ..... A63B 22/001 482/52
7,276,017 B2 * 10/2007 Chen ..... A63B 22/001 482/52
7,594,877 B2 * 9/2009 Anderson ..... A63B 21/154 482/51
7,771,324 B2 * 8/2010 Anderson ..... A63B 21/154 482/52
7,811,206 B2 * 10/2010 Chuang ..... A63B 22/0056 482/52
7,918,766 B2 * 4/2011 Lu ..... A63B 22/001 482/52

(Continued)

*Primary Examiner* — Garrett K Atkinson
(74) *Attorney, Agent, or Firm* — Muncy, Geissler, Olds & Lowe, P.C.

(57) ABSTRACT

A linkage mechanism with handles linked to an elliptical motion trajectory includes a main body having two guiding tracks with a changeable lifting angle, a flywheel assembly and two handles installed on a front side of the main body, a first linkage rod pivotally attached between the two handles and two cranks of the flywheel assembly. The two pedals respectively include a front end, and a second linkage rod is pivotally attached between the front end and each one of the cranks. A third linkage rod is pivotally attached between each one of the pedals and each one of the handles. Each one of the pedals along each one of the guiding tracks, and drives each one of the handles and the flywheel assembly to move.

6 Claims, 3 Drawing Sheets

(56) References Cited

U.S. PATENT DOCUMENTS

| | | | | |
|---|---|---|---|---|
| 8,808,149 | B2 * | 8/2014 | Huang | A63B 22/04 482/52 |
| 8,840,529 | B2 * | 9/2014 | Chen | A63B 22/0015 482/52 |
| 8,870,716 | B2 * | 10/2014 | Murray | A63B 21/225 482/51 |
| 8,936,535 | B1 * | 1/2015 | Chen | A63B 22/0664 482/52 |
| 9,067,101 | B1 * | 6/2015 | Chuang | A63B 22/0664 |
| 9,254,414 | B2 * | 2/2016 | Liu | A63B 22/0015 |
| 9,925,411 | B2 * | 3/2018 | Huang | A63B 21/225 |
| 10,369,404 | B2 * | 8/2019 | Smith | A63B 22/0015 |
| 2003/0013581 | A1 * | 1/2003 | Kaganovsky | A63B 22/0664 482/51 |
| 2007/0072742 | A1 * | 3/2007 | Chen | A63B 22/001 482/52 |
| 2007/0161464 | A1 * | 7/2007 | Chiles | A63B 22/0664 482/52 |
| 2008/0242516 | A1 * | 10/2008 | Lu | A63B 22/001 482/52 |
| 2010/0248899 | A1 * | 9/2010 | Bedell | A63B 22/0015 482/4 |
| 2015/0087481 | A1 * | 3/2015 | Liu | A63B 22/0664 482/52 |
| 2017/0128771 | A1 * | 5/2017 | Huang | A63B 21/225 |

* cited by examiner

LINKAGE MECHANISM WITH HANDLES LINKED TO ELLIPTICAL MOTION TRAJECTORY

BACKGROUND OF THE INVENTION

1. Technical Field

The present invention relates to a linkage mechanism of a fitness equipment, in particular, to a linkage mechanism with handles linked to an elliptical motion trajectory.

2. Description of Related Art

Since the use of an elliptical trainer for workout and exercise has the characteristics of simulating natural walking posture and achieving exercise outcome; the elliptical motion trajectory formed by the repetitive stepping actions of both feet of the exercising person is able to drive the linkage bars and the flywheels to move such that it is able to achieve the full-body workout with aerobic exercise effect while preventing knee joint injuries. Consequently, elliptical trainers are widely recommended and used by sports enthusiasts.

Presently, there are a variety of elliptical trainers in the market. The questions on how to allow exercising person to perform the stepping action with greater comfort, to provide greater stability during the stepping process and to achieve ergonomics and operating comfort etc. are important subjects to the design of an elliptical trainer.

BRIEF SUMMARY OF THE INVENTION

Accordingly, the primary objective of the present invention is to provide a linkage mechanism with handles linked to an elliptical motion trajectory such that it is able to provide a relatively more stable and comfortable full-body workout and exercise while achieving ergonomics and enhancing the convenience and labor-saving of the operation thereof.

To achieve the foregoing objective, the present invention provides a linkage mechanism with handles linked to an elliptical motion trajectory, comprising a main body, a flywheel assembly, two handles and two pedals. The main body includes two guiding tracks with a changeable lifting angle. The flywheel assembly includes two cranks and the flywheel is installed on a front side of the main body. Each one of the handles pivotally attached onto the front side of the main body corresponding to each other. A first linkage rod is pivotally attached between each one of the handles and each one of the cranks. Each one of the pedals includes a front end and a guiding wheel. A second linkage rod is pivotally attached between each one of the front ends and each one of the cranks. Each one of the guiding wheels is movably arranged on each one of the guiding tracks. A third linkage rod is pivotally attached between each one of the pedals and a bottom end of each one of the handles. Each one of the pedals is configured to move along each one of the guiding tracks, and is configured to drive each one of the handles and the flywheel assembly to move.

Preferably, wherein the flywheel assembly comprises at least two flywheel disks of different weights and a transmission belt arranged to surround between the at least two flywheel disks.

Preferably, wherein the third linkage rod is pivotally attached onto each one of the handles at a location adjacent to each one of the guiding wheels.

Preferably, wherein a pivotal attachment location between each one of the first linkage rods and each one of the handles is lower than a pivotal attachment location between each one of the handles and the main body.

Preferably, wherein each one of the pedals comprises two supporting racks forming a predefined angle with each other.

Preferably, wherein the main body includes a driving motor, and the two guiding tracks are driven by the driving motor to change the lifting angle relative to the main body.

Regarding the detailed structure or technical features of the present invention, details are provide in the following accompanied drawings and description. However, a person with ordinary skill in the art in the technical field of the present invention shall understand that such detailed description and the specific embodiments disclosed in the present invention are provided to illustrate the present invention only such that they shall not be treated as limitation of the scope of the claim of the present invention.

DETAILED DESCRIPTION OF THE INVENTION

The following provides preferred embodiments along with the accompanied drawings to describe the technical content and features of the present invention in detail. A person skilled in the art in this field is able to understand that the description and terms used to describe the embodiments refer to the superordinate descriptions not limited to the application field. For example, the terms of materials or shapes used include but not limited to the specified materials or shapes only. The terms of location positioning include but not limited to being arranged at, adjacent to, connected to or abutted to. The terms of quantity of each element such as "one" includes the quantity of one and more than one of plurality of elements. The directional terms of "up", "down", "inner", "outer", "top" and "bottom" etc. are descriptive terms as examples for normal direction of use, which shall not be treated as limitations to the scope of the claim.

Figure 1:
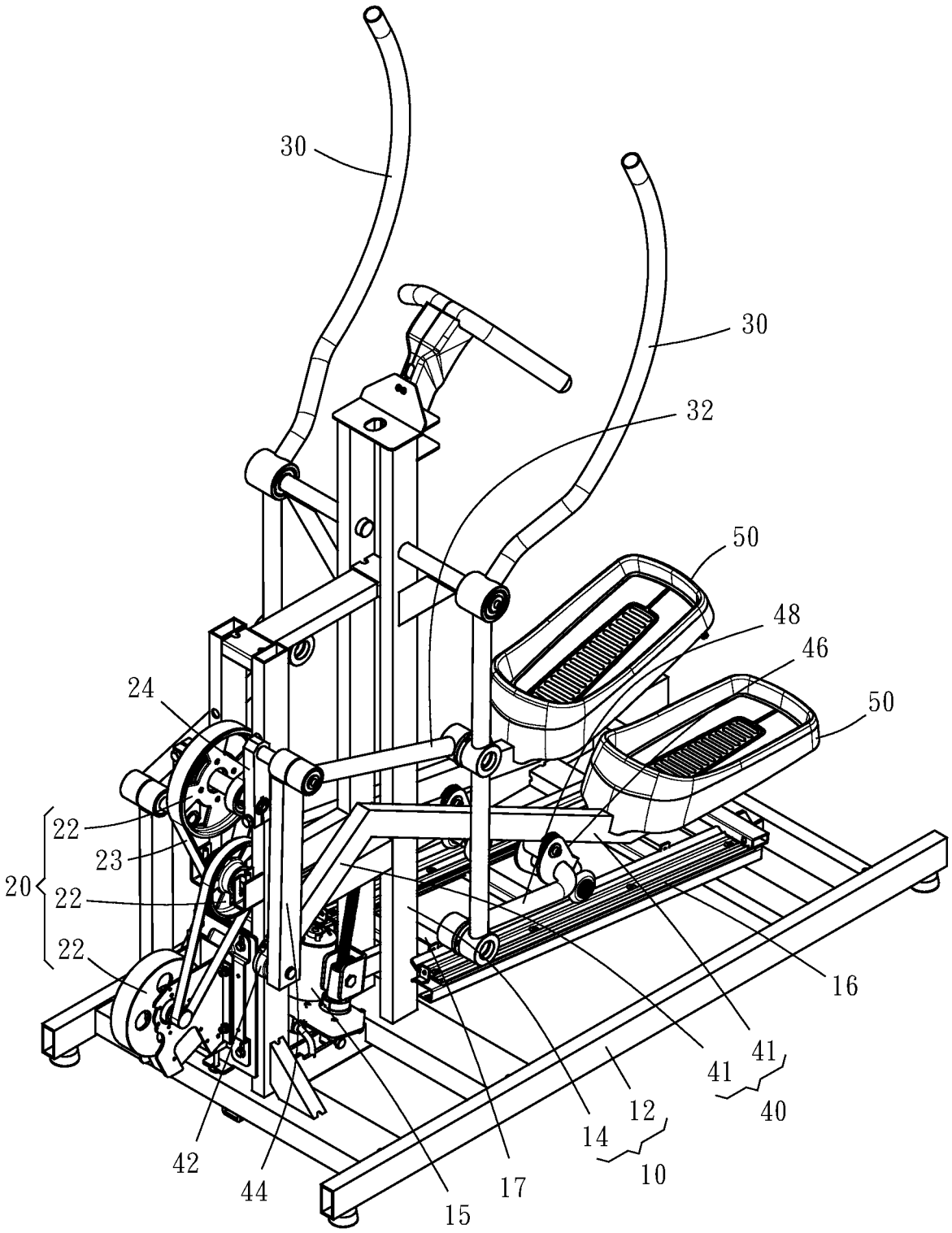
FIG. 1 is a perspective view of a preferred embodiment of the present invention.
Figure 2:
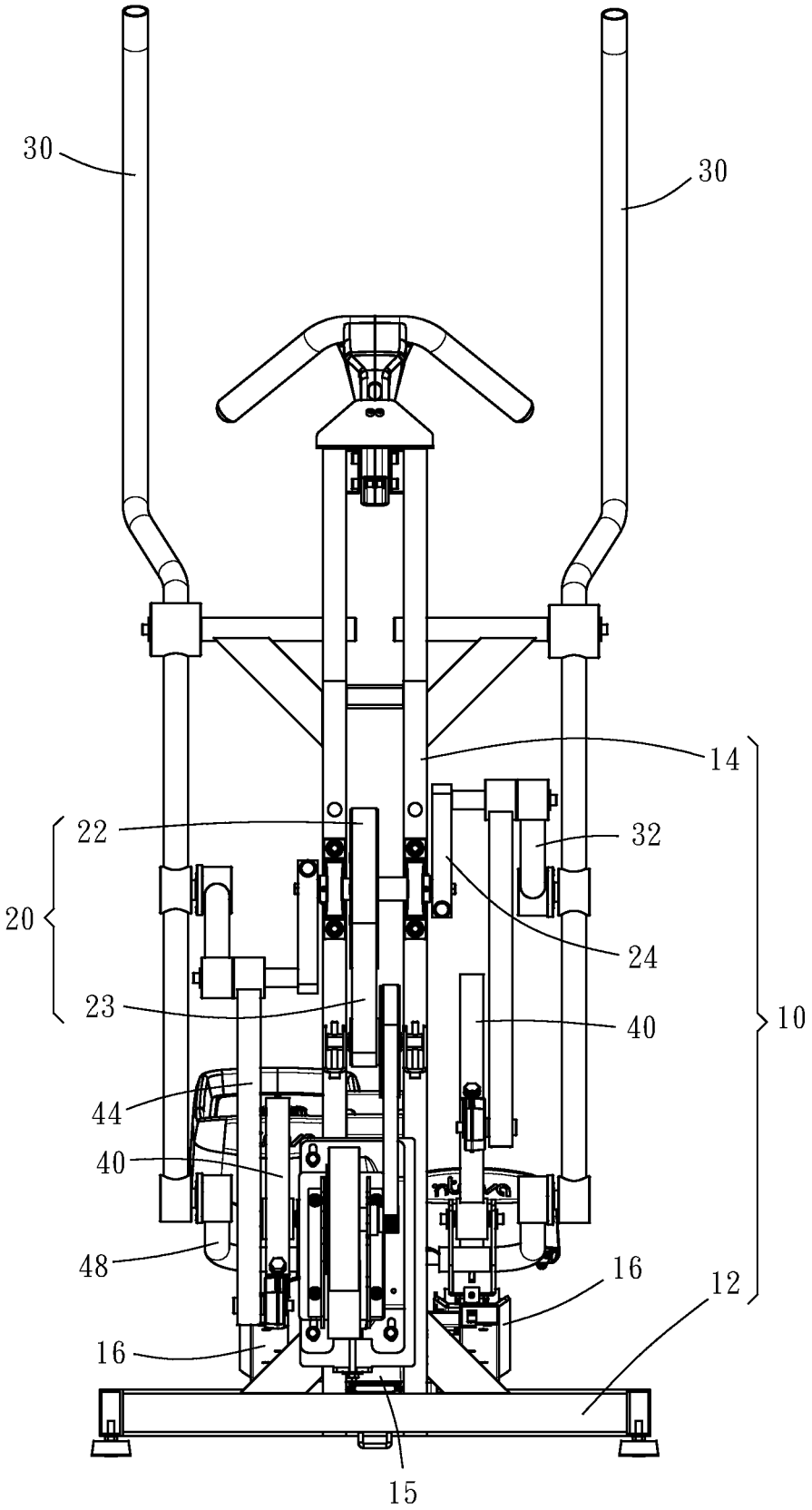
FIG. 2 is a front view of a preferred embodiment of the present invention.
Figure 3:
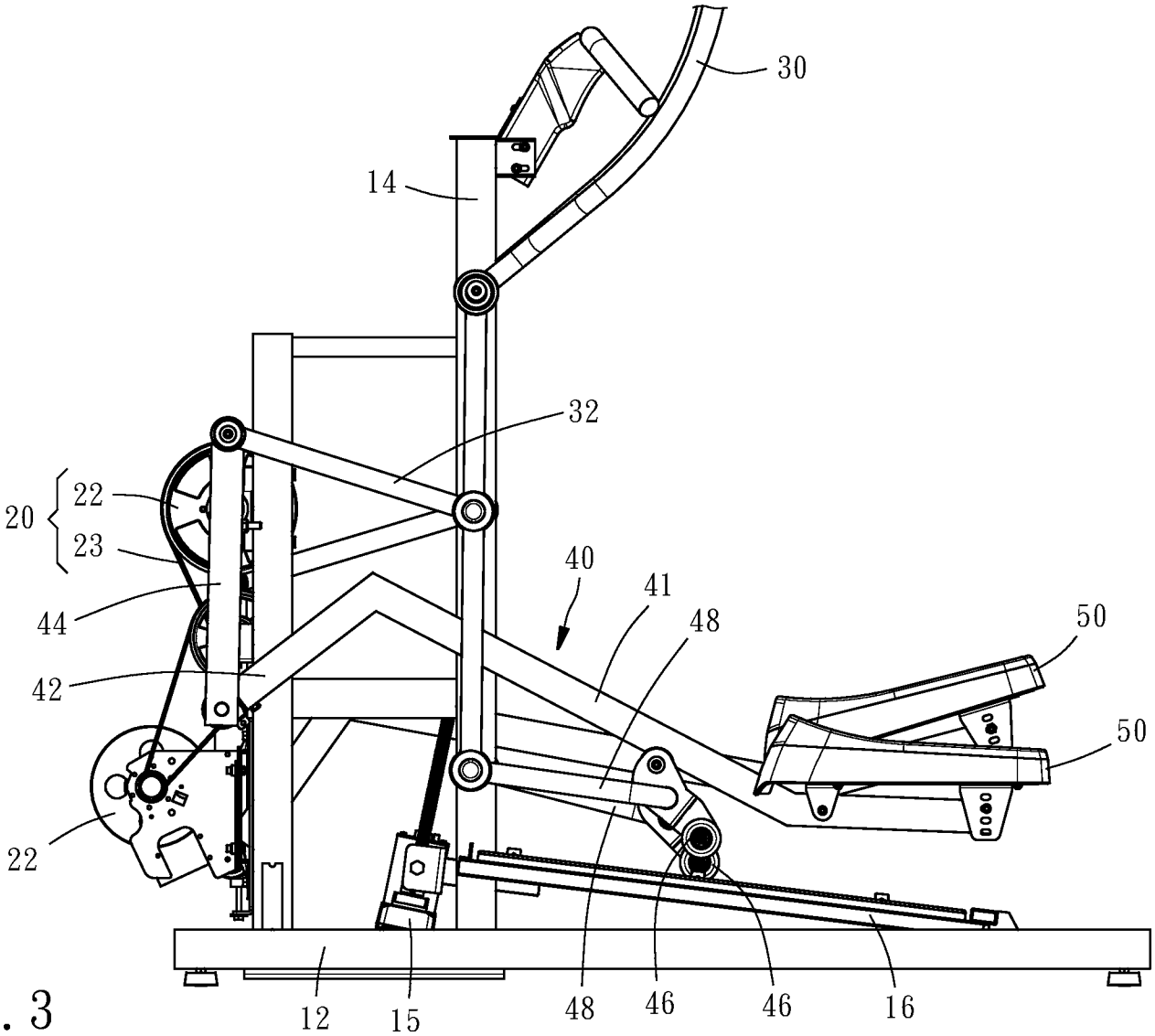
FIG. 3 is a side view of a preferred embodiment of the present invention.

As shown in FIG. 1 to FIG. 3, a linkage mechanism with an elliptical motion trajectory of the present invention, comprising a main body 10, a flywheel assembly 20, two handles 30, and two pedals 40. The main body 10 includes a base 12 and a vertical column 14 arranged on the base 12. The base 12 includes a driving motor 13 installed thereon and two guiding tracks 16 arranged at two sides of the vertical column 14 respectively. The rear sides of the two guiding tracks 16 are pivotally attached onto the base 12, and the front sides of the two guiding tracks 16 are jointly provided with an attachment rod 17. The attachment rod 17 can be driven by the driving motor 15 in order to allow the two guiding tracks 16 to change a lifting angle relative to the base 12. By using the guiding tracks 16 with different lifting angles, the motion effect of different level of inclinations can be generated.

In a preferred embodiment of the present invention, the flywheel assembly 20 comprises a plurality of flywheel disks 22 of different weights and a transmission belt 23 arranged to surround the flywheel disks 22 as an example for illustration. The cooperative combination of the flywheels 22 and the transmission belt 23 is able to obtain a relatively greater balance between the speed ratio of the elliptical motion and the weight of the flywheel. The flywheel assembly 20 is installed on the front side of the vertical column 14 of the main body 10, and the flywheel assembly 20 includes two cranks 24.

The two handles 30 are pivotally attached onto the two sides of the vertical column 14 of the main body 10 respectively. The top end of each handle 30 can be provided to allow the exercising person to grab thereon. The bottom end of each handle 30 extends in a direction toward the base 12. A first linkage rod 32 is pivotally attached between the body portion of each handle 30 and each crank 24. To be more specific, a pivotal attachment location between the first linkage rod 32 and the handle 30 is lower than a pivotal attachment location between the handle 30 and the vertical column 14.

The two pedals 40 respectively include a front end 42. A second linkage rod 44 is pivotally attached between each one of the font ends 42 and each one of the cranks 24. Each one of the pedals 40 includes a guiding wheel 46 installed thereon, and each one of the guiding wheels 46 is rollably arranged on each one of the guiding tracks 16. A third linkage rod 48 is pivotally attached between each one of the pedals 40 and the bottom end of each one of the handles 30. In this preferred embodiment, the third linkage rod 48 is pivotally attached onto each one of the handles 30 at a location adjacent to each one of the guiding wheels 46 as an example for illustration. The pedals 40 are able to move forward and backward together with the guiding wheels 46 and along the guiding tracks 16. When the rear end of each one of the pedals 40 is installed with a stepping portion 50 for the foot of the exercising person to place thereon, the two feet of the exercising person can then use the aforementioned linkage mechanism to perform the motion of elliptical trajectory continuously. During the movement of each one of the pedals 40, each one of the handles 30 is also driven to swing simultaneously. It shall be noted that in this preferred embodiment, the pedals 40 can selectively comprise two supporting racks 41 forming a predefined angle with each other in order to allow the pedals 40 to have a stroke design of greater versatility and flexibility.

According to the aforementioned assembly and description, when the exercising person is standing on the two stepping portions 50 and holding the top ends of the two handles 30, he or she can step onto the two pedals 40 with both feet in order to allow the pedals 40 to move forward and backward along the guiding tracks 16. In addition, the pedals 40 also push the cranks 24 and the handles 30 via the second linkage rods 44 and the third linkage rod 48 in order to allow the flywheel assembly 20 to generate rotational inertia. Furthermore, the cranks 24 drive the first linkage rod 32 to move each one of the handles 30 linked thereto in order to further drive the pedals 40 and the handles 30 to move, thereby allowing the exercising person to perform fill-body workout and exercise.

Since the inertia of the flywheel assembly 20 drives the first linkage rod 32 and the second linkage rod 44 directly, the handles 30 and the pedals 40 can be driven to move simultaneously, such that the exercising person is able to step the elliptical motion continuously in a convenient and labor-saving manner while feeling that the force feedback is of a relatively greater comfort, thereby further reducing non-smooth turning occurred in the elliptical motion. In addition, the exercising person is not required to exert an overly great stepping force to drive the entire linkage mechanism, and the stepping force action of the pedals 40 can be more stable. Consequently, the device is able to satisfy the training requirements, to comply with the ergonomics and to reduce sports injuries as well as to enhance the effect of exercise and work out. Moreover, the overall size of the present invention is relatively compact such that it is able to satisfy diverse use demands.

What is claimed is:

1. A linkage mechanism with handles linked to an elliptical motion trajectory, comprising:

a main body having two guiding tracks with a changeable lifting angle;

a flywheel assembly installed on a front side of the main body and having two cranks;

two handles pivotally attached onto the front side of the main body corresponding to each other, and a first linkage rod pivotally attached between each one of the handles and each one of the cranks; and two pedals with each one of the pedals having a front end and a guiding wheel, a second linkage rod pivotally attached between each one of the front ends and each one of the cranks; each one of the guiding wheels movably arranged on each one of the guiding tracks; a third linkage rod pivotally attached between each one of the pedals and a bottom end of each one of the handles; each one of the pedals configured to move along each one of the guiding tracks, and configured to drive each one of the handles and the flywheel assembly to move.

2. The linkage mechanism with handles linked to an elliptical motion trajectory according to claim 1, wherein the flywheel assembly comprises at least two flywheel disks of different weights and a transmission belt arranged to surround between the at least two flywheel disks.

3. The linkage mechanism with handles linked to an elliptical motion trajectory according to claim 1, wherein the third linkage rod is pivotally attached onto each one of the handles at a location adjacent to each one of the guiding wheels.

4. The linkage mechanism with handles linked to an elliptical motion trajectory according to claim 1, wherein each one of the pedals comprises two supporting racks forming a predefined angle with each other.

5. The linkage mechanism with handles linked to an elliptical motion trajectory according to claim 1, wherein a pivotal attachment location between each one of the first linkage rods and each one of the handles is lower than a pivotal attachment location between each one of the handles and the main body.

6. The linkage mechanism with handles linked to an elliptical motion trajectory according to claim 1, wherein the main body includes a driving motor, and the two guiding tracks are driven by the driving motor to change the lifting angle relative to the main body.

* * * * *